United States Patent [19]

McLane

[11] 4,203,392

[45] May 20, 1980

[54] HEAT EXCHANGER

[76] Inventor: Jack S. McLane, 5589 Crestview Dr., Acworth, Ga. 30101

[21] Appl. No.: 883,207

[22] Filed: Mar. 3, 1978

[51] Int. Cl.[2] ..... F22B 5/00

[52] U.S. Cl. ..... 122/17; 122/37; 122/134

[58] Field of Search ..... 122/17, 155, 156, 134, 122/37

[56] References Cited

U.S. PATENT DOCUMENTS

| | | | |
|---|---|---|---|
| 1,037,029 | 8/1912 | Lukacs | 122/37 |
| 1,811,938 | 6/1931 | Irwin | 122/37 |
| 2,046,455 | 7/1936 | Hellig | 122/37 |
| 2,385,854 | 10/1945 | Wolfersperger | 122/17 |

*Primary Examiner*—Edward G. Favors
*Attorney, Agent, or Firm*—James A. Hinkle

[57] ABSTRACT

A heat exchanger in which a fluid maintenance tank has a spiral coil for heating the fluid therein. A source of heat is applied to the upper end of the spiral coil and the heat is caused to course through the spiral coil to the other end thereof during which heat is being exchanged to the medium to be heated. The uppermost portion of the tank is thereby heated first. A blower means is connected in operative relationship with the lower end of the spiral tubing to draw the heat and products of combustion through the tubing and to exhaust same. The heat exchanger may be a hot air furnace, a hot water heater or a fluid superheater with a reserve compartment.

1 Claim, 8 Drawing Figures

HEAT EXCHANGER

BACKGROUND OF THE INVENTION

The present invention relates to heat exchangers wherein the liquids utilized may be water, air or other suitable fluids in which the exchange of heat is desired.

Heretofore heat exchange systems have tended to be designed along the lines which make them highly inefficient. For instance, in the case of home heating systems and furnaces, the typical system comprises a burner which heats an heat exchange system which then transfers heat through the heat exchanger to ambient air flowing across the exchanger. As is commonly known, considerable heat is lost with the exchange since the heating gases flow rapidly across the heat exchanger and directly into the flue pipe, and are subsequently exhausted to the atmosphere. In these systems, the heat flows from a lower area to an upper area and generally relies upon convection currents to cause the flue gases to be exhausted. As can be appreciated, considerable heating value is lost through non-transference in the heat exchange as just described.

In the case of heating water for home use, or industrial use for that matter, a common system is to have an enclosed water tank in which are spiraled coils of tubing through which flows the water to be heated. At the lower most portion of the tank there is normally a burner whose heat is allowed to pass over the coils, thereby heating the water in the coils for use within the home. Again, as in the system of the home furnace, the heating value which is not transferred to the coils is exited at the top of the tank into the flue pipe and thence to the ambient atmosphere. As can be appreciated, such a system is inefficient because a great portion of the heating value is not transferred to the medium to be heated and consequently is lost directly to the atmosphere.

Accordingly, it is a general object of the present invention to provide a heat exchange system having spiral tubing directly connected to the source of heat at one end and suction means at the other end of the tubing for drawing the exhaust gases through the tubing so as to heat the surrounding medium.

Yet another object of this invention is to provide a heat exchange system which heats the medium to be heated from the top of the container containing the medium to the bottom thereof.

Another object of the invention is the provision of a heat exchanger using a plurality of spiral coils connected to a manifold through which heat is directly applied within the coils spiraling through a double tank separated near the midpoint defining a hot tank and a cold tank wherein the hot tank is used as a quick superheater while the bottom tank is utilized as a reserve tank.

Another object of the present invention is the provision of a heat exchanger which operates as a hot air furnace utilizing the blower that blows hot air around the spiraled heating coils to also exhaust the heating coils to the ambient atmosphere.

SUMMARY OF THE INVENTION

In one preferred embodiment of the invention, a water holding tank has included therewith a spiral coil exhausting to the ambient atmosphere by means of a suction blower which draws heat through the spiral coil from a flame at the uppermost end of the coil thereby heating the water surrounding the coil from top to bottom.

Another preferred embodiment of the present invention discloses a furnace system in which a spiral coil is mounted in a shell and utilizes a blower to move the hot flue gases through the spiral coil and into the ambient atmosphere after the spiral coil has heated air within the container and become cool at the exit point. In addition, the blower is utilized for circulation of outside air across the heating coils and to drive the heated air throughout the area to be heated.

Yet another preferred form of the invention is the provision of a two chambered tank utilizing a spiral coil, preferably of multi-tube design, in which a portion of the coil is placed in one tank and the remaining portion of the coil is placed in a separate tank, with the first tank being a super heated tank and the second tank being a reserve heat tank. In this embodiment the fluid is heated by means of hot gases directly introducted into the spiraled coil in the first upper tank and with the spent gases exiting at the lower end of the spiral coil placed near the bottom of the second tank.

DESCRIPTION OF THE PREFERRED EMBODIMENTS

Figure 1:
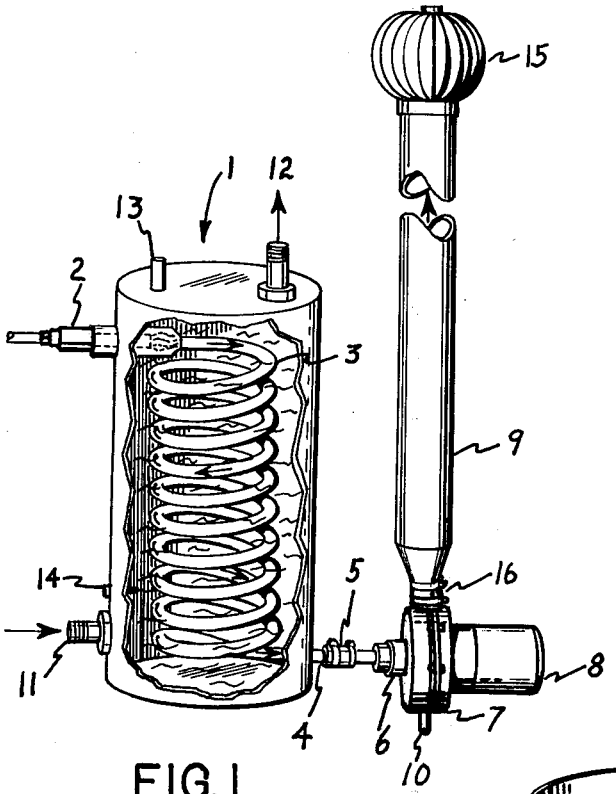
FIG. 1 is a perspective view of one embodiment embodying the principles of the invention.

Referring to the drawings wherein like reference characters designate corresponding parts throughout the several FIGURES, one preferred embodiment of the present invention is shown in FIG. 1 by the numeral 1 indicating an insulated water tank. Heat is supplied to the water tank for the purpose of heating water therein by means of a pressure burner 2 utilizing natural gas or other similar fuels which burn a flame directly at the upper throat of the spiral stainless steel tubing 3. The spiral tubing then exhausts the spent flue gases and other products of combustion out of the exhaust end 4 attached by means of a flexible coupling 5 to a coupling nipple 6 mounted to an exhaust blower 7.

The exhaust blower 7 is run by an electric motor 8 which, by action of the blower 7, exhausts the products of combustion from the heater to the exhaust stack 9. Numeral 10 designates a condensate drain for draining any available moisture which may collect in the blower 7 for the prevention of rust and other harmful effect upon the blower.

In the water heater shown in FIG. 1, cold water is supplied through inlet 11 located near the bottom of the tank while the heated water exits through the hot water outlet 12. As is common in such installations, a safety valve 13 is provided to prevent over pressurization of the tank. In order to provide temperature control for the heated water a thermostat 14 is provided to sense the temperate of the heated water and this control then dictates the burner operation for heating the water in a conventional manner.

The exhaust stack 9 is coupled to the exhaust blower housing 7 by means of a flexible coupling and clamping arrangement 16. The stack has at its uppermost end an automatic vent cap 15 which is driven by the exhaust as moved by the exhaust blower 7 or, in the alternative, is driven by the force of the outside wind in a conventional manner.

Figure 2:
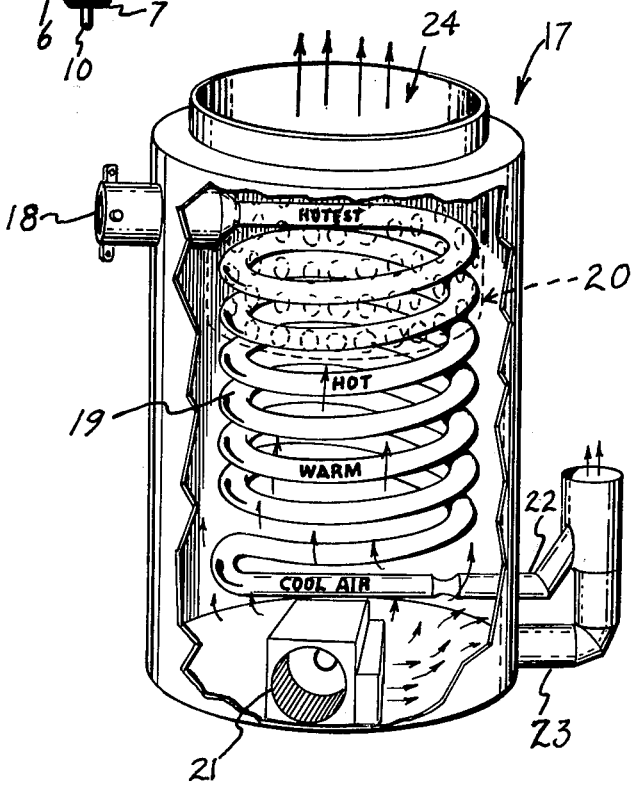
FIG. 2 is a perspective view embodying principles of the invention in another perferred form.

Referring now to FIG. 2, which depicts the hot air furnace which may be typically used in home heating situations, the furnace is indicated by numeral 17 which comprises an outside shell for enclosing the operative parts of the furnace. A pressure burner utilizing gas, oil or other similar fuels may be affixed in opening 18 for supplying the furnace with a source of heat. Much like that which was described in the heater of FIG. 1, a spiral tubing 19 carries the source of heat inside the tubing from the top of the furnace to the bottom thereof. It is anticipated that a baffling system, or heat shield, 20 may be provided to more effectively utilize the heat given off through the spiral tubing 19, and such baffling systems are known to the prior art.

A blower system 21 is provided at the lower portion of the furnace and may comprise any suitable blower to effect the desired operation. Generally, this blower provides positive pressure toward the top most portion of the furnace to provide a flow of cooler air across the spiral tubing which provides a heat exchange to the medium being passed thereacross. In addition, the blower 21 provides an exhaust pressure through the manifold 23 to provide a positive exhaust from the spiral tubing 19 by means of the exhaust leg 22 which is in fluid communication with the manifold 23. As can be seen in this particular furnace system, the desired efficiency is achieved by taking cooler air from the exterior through the blower system and then passing it from the bottom of the furnace to the uppermost portion of the furnace thereby engaging the air with the heat exchanger 19 to effectively take all of the heating BTU's available from the heat exchange system 19. Therefore, it is seen that the heated flow through the connection 24 to the hot air plenum has extracted a high degree of heat exchange efficiency while the exhaust through the manifold 23 is in a cooled state.

Figure 3A:
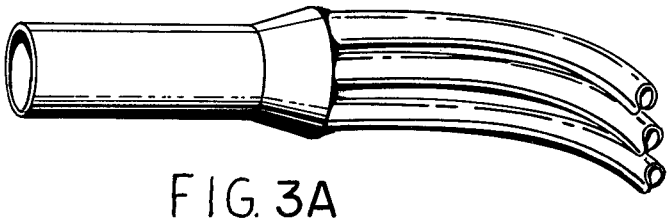
FIG. 3A is a perspective view of a multi-tubed intake manifold assembly utilized in the present invention.
Figure 3B:
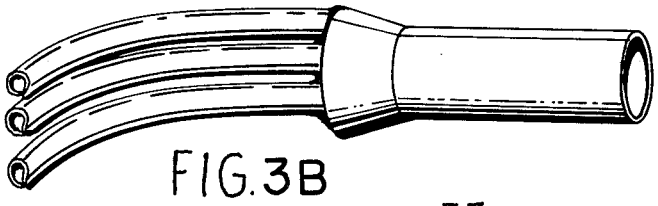
FIG. 3B is a perspective view of a multi-tubed exhaust manifold utilized in the present invention.
Figure 3:
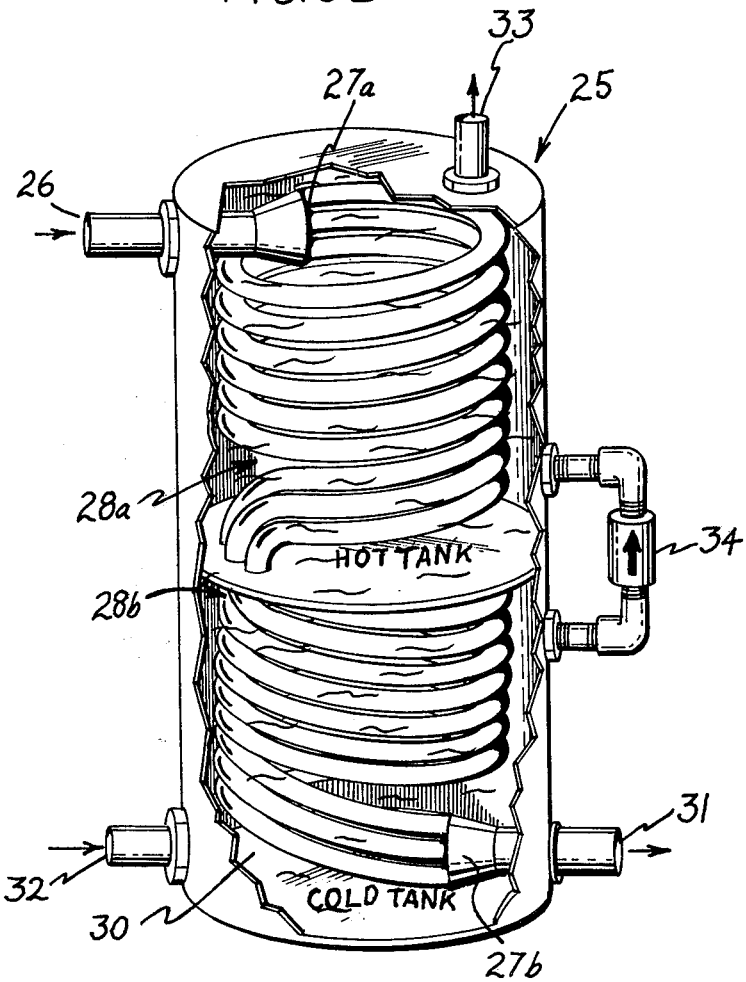
FIG. 3 is a perspective view of the present invention embodying the principles in another preferred form.

In FIG. 3 a super heater is shown in which a water holding tank is divided into two compartments, one of which provides a super heated compartment and the other a somewhat cooler reserve compartment for storing water. This type of system provides an efficient means for super heating water at desired times without having to heat an entire tank to the same degree value when the necessary reservoir of super heated water necessary for a desired application is less than the entire tank capacity. As shown in FIG. 3, the superheat exchanger is denoted by numeral 25. As in the other applications described, a pressure burner is fitted into the manifold 26 to supply heat energy directly into the spiral tubing which heats the contained water. The inlet manifold **27*a* comprises, in this particular application, three parallel spiral tubes for more efficient heating of the super heater tank. The super heated tank is indicated by numeral 28*a* and the non super heated reserve tank is indicated by 28*b*. Dividing the overall tank 25 into two separate compartments is a dividing plate 29 which snugly fits the interior of the tank 25, but allows the spiral tubing to pass there through. The exhaust gases and by products of combustion exit through exhaust manifold 27*b* at the colder end of the tank through outlet 31. A cold water intake into the tank is shown by inlet 32. By the time the products of combustion have reached the area of the spiral tubing, in-dicated by numeral 30, essentially all of the heat has been removed therefrom for heating of the water during previous travel down the ttubing and, the exhaust which is exited through outlet 31** is cool.

The super heated water, or steam, exits through opening 33 to the desired place of application. Exchange between the colder water tank **28*b* and the super heated tank 28*a* is accomplished by means of a check valve 34** which interconnects piping from one tank to the other. For clarity, the intake manifold and exhaust manifold for the burner system and associated tubing are shown more clearly in FIGS. 3A and 3B.

Figure 4:
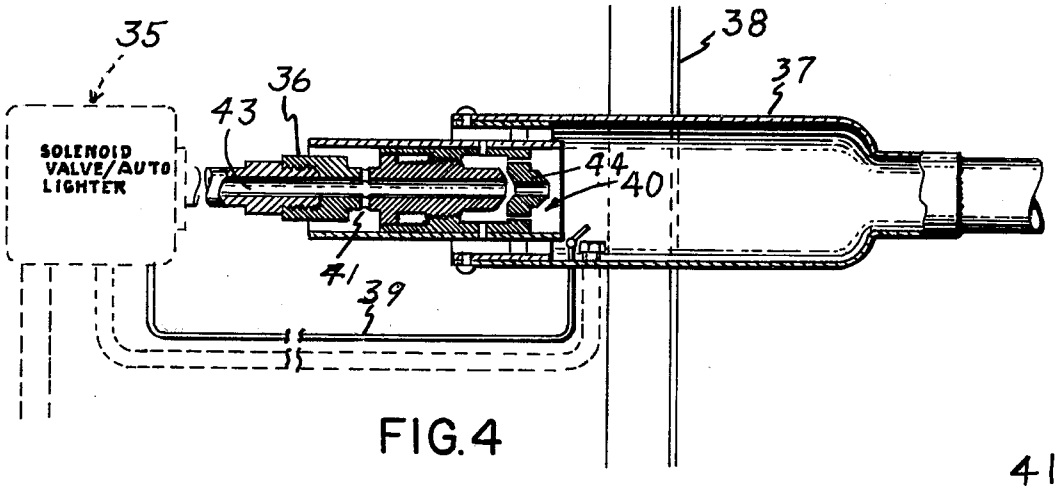
FIG. 4 is a section view taken along the center line of a typical burner nozzle assembly utilized in the present invention.
Figure 5:
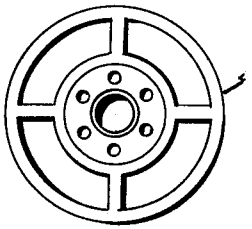
FIG. 5 is a vertical view of the front of the burner nozzle assembly looking directly thereinto.
Figure 6:
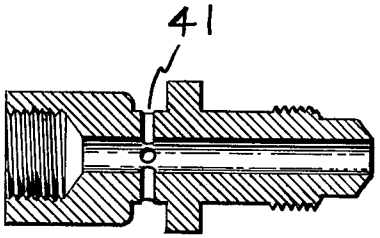
FIG. 6 is an enlarged vertical section view of a portion of the burner nozzle assembly.

In FIG. 4 a typical burner assembly mounted in the manifold of the spiral tubing in the various applications is shown in more detail.

A solenoid valve and auto lighter system for supplying fuel to the burning chamber 37 of the spiral tubing in each of the applications is shown in FIG. 4. The solenoid valve and auto lighter assembly is shown in phantom by numeral 35 and is of convention design. The actual gas burner 36 is fitted in conventional ways into burning chamber 37 fitted into the wall 38 of the tank utilized in each of the applications. A portion of the piping from the valve 35 to the burning chamber 37 is denoted by numeral 39. The nozzle for the burner shown by numeral 40 includes a tip 44 through which the gas and air mixture passes to produce the desired flame within the burning chamber 37. The arrangement for mixing the air and the gases comprises a plurality of orifices 31 within the burner assembly 36 and is of known design.

Various modifications may be made of the invention without departing from the scope thereof and it is desired, therefore, that only such limitations shall be placed thereon as are imposed by the prior art and which are set forth in the appended claims.

What is claimed is:

1. A heat exchanger comprising a tank enclosure having an uppermost end and a lowermost end, a medium to be heated flowing through the tank, heat exchange tubing located within the tank enclosure and in heat exchange relationship with the medium to be heated, said tubing configured into a spiral to substantially fill the tank enclosure, one end of the tubing having a burner manifold connected therewith and mounted at the uppermost end of the tank enclosure, the other end of the tubing mounted at the lowermost end of the tank enclosure, a source of heat connected directly to the burner manifold for supplying heat to the interior of the spiral tubing, means associated with the end of the tubing at the lowermost end of the tank enclosure for drawing the heat within the tubing downwardly there through and for exhausting cooled and spent heat to the exterior of the tank enclosure, wherein the tank enclosure is divided into two separate fluid tight compartments comprising a super heat compartment and a reserve compartment, the spiral tubing comprising at least three parallel individual tubes connecting the burner manifold at the uppermost end of the tank enclosure with the lowermost end of the tank enclosure, whereby the medium being heated and the source of heat to the heat exchanger are at their respective greatest relative temperatures at the uppermost end of the tank enclosure and at their lesser relative temperatures at the lowermost end of the tank enclosure thereby extracting the maximum heating value from the source of heat prior to exhausting thereof.

* * * * *